US005437126A

United States Patent [19]

Ramiro

[11] Patent Number: 5,437,126

[45] Date of Patent: Aug. 1, 1995

[54] INFLATABLE AND FOLDABLE OUTDOOR BED

[76] Inventor: Apolinar Z. Ramiro, 993 N. Wilson Ave., Pasadena, Calif. 91104

[21] Appl. No.: 320,323

[22] Filed: Oct. 11, 1994

[51] Int. Cl.[6] ..... E04H 15/20

[52] U.S. Cl. ..... 52/2.22; 52/2.24

[58] Field of Search ..... 52/2.11, 2.17, 2.18, 52/2.22, 2.24, 2.13; 135/87

[56] References Cited

U.S. PATENT DOCUMENTS

| | | | |
|---|---|---|---|
| 3,432,609 | 3/1969 | Duvall et al. | 52/2.18 X |
| 4,296,960 | 10/1981 | Winchester | 52/2.17 X |
| 5,007,212 | 4/1991 | Fritts et al. | 52/2.18 |
| 5,205,086 | 4/1993 | Heim | 52/2.18 X |
| 5,247,768 | 9/1993 | Russo | 52/2.22 X |

FOREIGN PATENT DOCUMENTS

| | | | |
|---|---|---|---|
| 2440168 | 5/1980 | France | 52/2.11 |

*Primary Examiner*—Lanna Mai

[57] ABSTRACT

A new and improved inflatable and foldable outdoor bed having a bed portion. A left wall is foldably secured to the bed portion. The left wall folds upwards perpendicular to the bed portion. A right wall is foldably secured to the bed portion. The right wall folds upwards perpendicular to the bed portion. Included in the invention is a roof portion having a right portion and a left portion. The right portion is foldably secured to the left wall. The left portion of the roof portion folds over to the right wall and is secured thereto with end portions extending outwardly therefrom. A back portion is foldably secured to the bed portion. The back portion folds upwards perpendicular to the bed portion coupling with a top edge of the right wall and a top edge of the left wall. A front portion is foldably secured to the bed portion. The front portion folds Upwards perpendicular to the bed portion coupling with a bottom edge of the right wall and a bottom edge of the left wall. A plurality of inflatable mattresses are secured within the bed portion, the left wall, the right wall, the roof portion, the back portion, and the front portion, each of the inflatable mattresses having an inflation tube theresecured.

4 Claims, 4 Drawing Sheets

INFLATABLE AND FOLDABLE OUTDOOR BED

BACKGROUND OF THE INVENTION

1. Field of the Invention

The present invention relates to an inflatable and foldable outdoor bed and more particularly pertains to providing a shelter for the outdoors with an inflatable and foldable outdoor bed.

2. Description of the Prior Art

The use of inflatable structures is known in the prior art. More specifically, inflatable structures heretofore devised and utilized for the purpose of providing shelter are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,205,086 to Heim discloses an inflatable tent.

U.S. Pat. No. 3,840,919 to Middleton discloses a combined sleeping bag and inflatable tent.

U.S. Pat. No. 5,247,768 to Russo discloses an inflatable structure.

U.S. Pat. No. 3,457,684 to Wood, Jr. discloses a self-supporting inflatable shelter.

U.S. Pat. No. 4,959,901 to Parish discloses a portable inflatable shelter and method of erection thereof.

U.S. Pat. No. 5,007,212 to Fritts et al. discloses an inflatable shelter.

While these devices fulfill their respective, particular objective and requirements, the aforementioned patents do not describe an inflatable and foldable outdoor bed for providing a shelter for the outdoors.

In this respect, the inflatable and foldable outdoor bed according to the present invention substantially departs from the conventional concepts and designs of the prior art, and in doing so provides an apparatus primarily developed for the purpose of providing a shelter for the outdoors.

Therefore, it can be appreciated that there exists a continuing need for new and improved inflatable and foldable outdoor bed which can be used for providing a shelter for the outdoors. In this regard, the present invention substantially fulfills this need.

SUMMARY OF THE INVENTION

In the view of the foregoing disadvantages inherent in the known types of inflatable structures now present in the prior art, the present invention provides an improved inflatable and foldable outdoor bed. As such, the general purpose of the present invention, which will be described subsequently in greater detail, is to provide a new and improved inflatable and foldable outdoor bed and method which has all the advantages of the prior art and none of the disadvantages.

To attain this, the present invention essentially comprises a bed portion having a top edge, a bottom edge, a right edge, and a left edge. The device contains a left wall having a right edge, a left edge, a top edge, and a bottom edge. The right edge is foldably secured to the left edge of the bed portion. The top edge and the bottom edge have a VELCRO strip theresecured. The left wall folds upwards perpendicular to the bed portion. The device contains a right wall having a right edge, a left edge, a top edge, and a bottom edge. The left edge is foldably secured to the right edge of the bed portion. The top edge, the :bottom edge, and the right edge having a VELCRO strip theresecured. The right wall folds upwards perpendicular to the bed portion. The device contains a roof portion having a right portion and a left portion. The roof portion has VELCRO on end portions thereof. The left portion has a VELCRO strip secured to an end portion thereof. The right portion is foldably secured to the left edge of the left wall. The left portion of the roof portion folds over to the right wall and is secured thereto by the VELCRO strip to the right edge of the right wall with the end portions extending outwardly therefrom. The device contains a back portion having a top edge, a bottom edge, a right edge, a left edge, an inner surface, and an outer surface. The bottom edge is foldably secured to the top edge of the bed portion. The outer surface of the right edge and the left edge have VELCRO strips thereon. The back portion folds upwards perpendicular to the bed portion with the VELCRO strips thereof coupling with the VELCRO strips of the top edge of the right wall and the top edge of the left wall. The device contains a front portion having a top edge, a bottom edge, a right edge, a left edge, an inner surface, and an outer surface. The top edge is foldably secured to the bottom edge of the bed portion. The outer surface of the right edge and the left edge having VELCRO strips thereon. The front portion folds upwards perpendicular to the bed portion with the VELCRO strips thereof coupling with the VELCRO strips of the bottom edge of the right wall and the bottom edge of the left wall. The device contains a triangular end flap having VELCRO strips secured to an inner portion thereof. The VELCRO strips of the triangular end flap are coupled with the VELCRO strips on the end portions of the roof portion. The device contains a plurality of inflatable mattresses. One of the plurality of mattresses are secured within a zippered portion of each of the following: the bed portion, the left wall, the right wall, the roof portion, the back portion, and the front portion. Each of the inflatable mattresses have an inflation tube theresecured. The device contains an air pump. The air pump is attachable to the inflation tube of the inflatable mattresses. The air pump serves to fill the mattresses with air.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved inflatable and foldable outdoor bed which has all the advantages of the prior art inflatable structures and none of the disadvantages.

It is another object of the present invention to provide a new and improved inflatable and foldable outdoor bed which may be easily and efficiently manufactured and marketed.

It is a further object of the present invention to provide a new and improved inflatable and foldable outdoor bed which is of durable and reliable construction.

An even further object of the present invention is to provide a new and improved inflatable and foldable outdoor bed which is susceptible of a low cost of manufacture with regard to both materials and labor, and which accordingly is then susceptible of low prices of sale to the consuming public, thereby making such an inflatable and foldable outdoor bed economically available to the buying public.

Still yet another object of the present invention is to provide a new and improved inflatable and foldable outdoor bed which provides in the apparatuses and methods of the prior art some of the advantages thereof, while simultaneously overcoming some of the disadvantages normally associated therewith.

Even still another object of the present invention is to provide a new and improved inflatable and foldable outdoor bed for providing a shelter for the outdoors.

Lastly, it is an object of the present invention to provide a new and improved inflatable and foldable outdoor bed having a bed portion. A left wall is foldably secured to the bed portion. The left wall folds upwards perpendicular to the bed portion. A right wall is foldably secured to the bed portion. The right wall folds upwards perpendicular to the bed portion. Included in the invention is a roof portion having a right portion and a left portion. The right portion is foldably secured to the left wall. The left portion of the roof portion folds over to the right wall and is secured thereto with end portions extending outwardly therefrom. A back portion is foldably secured to the bed portion. The back portion folds upwards perpendicular to the bed portion coupling with a top edge of the right wall and a top edge of the left wall. A front portion is foldably secured to the bed portion. The front portion folds upwards perpendicular to the bed portion coupling with a bottom edge of the right wall and a bottom edge of the left wall. A plurality of inflatable mattresses are secured within the bed portion, the left wall, the right wall, the roof portion, the back portion, and the front portion, each of the inflatable mattresses having an inflation tube theresecured.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
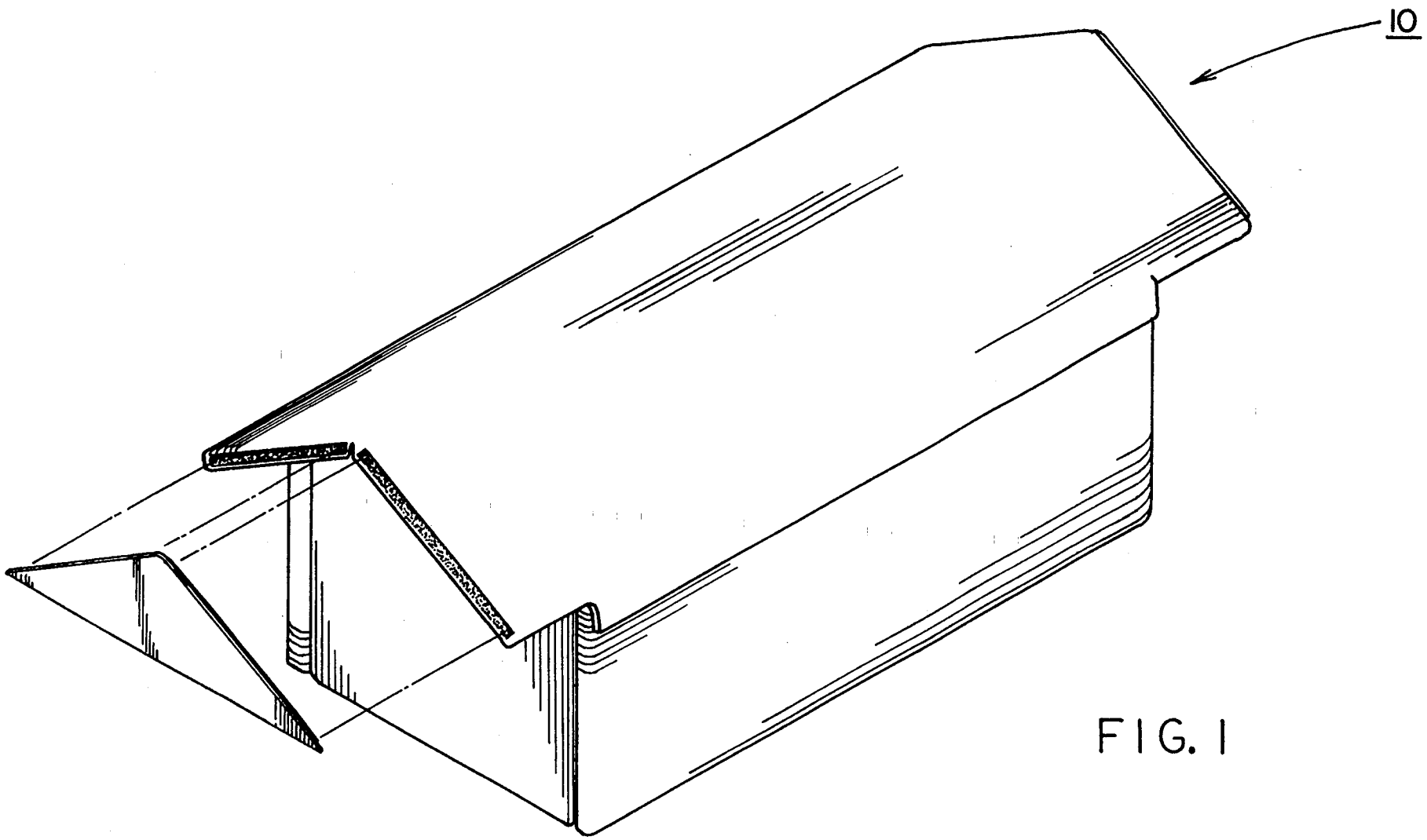
FIG. 1 is a perspective view of the preferred embodiment of the inflatable and foldable outdoor bed constructed in accordance with the principles of the present invention.
Figure 2:
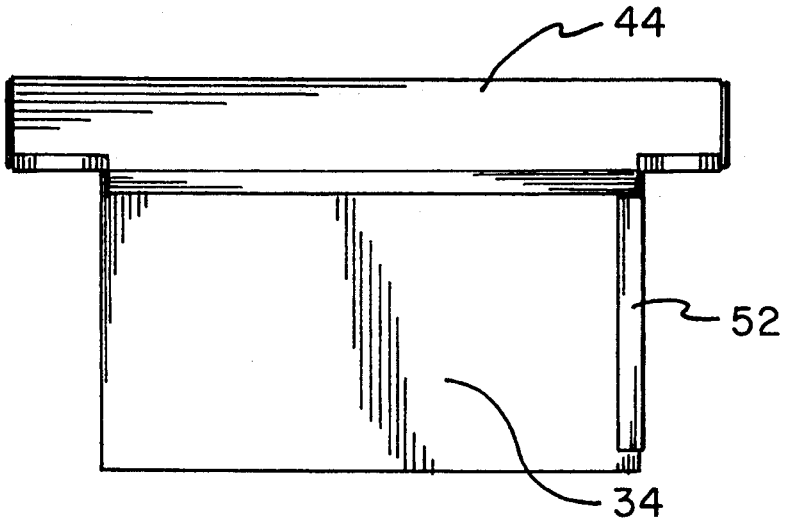
FIG. 2 is an elevated side view of the present invention.
Figure 3:
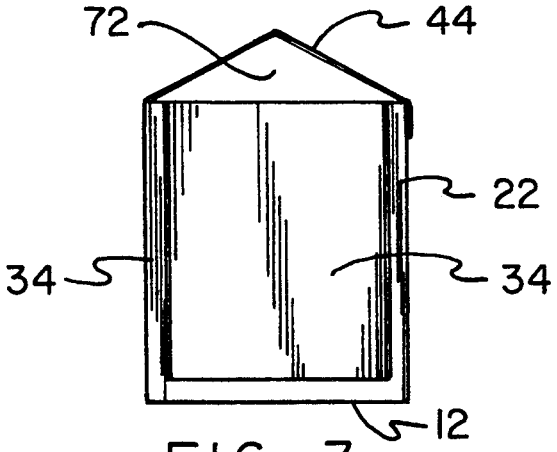
FIG. 3 is an elevated rear view of the present invention.
Figure 4:
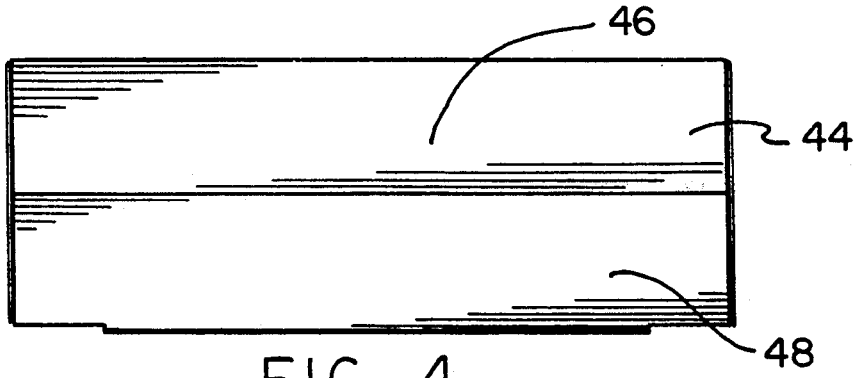
FIG. 4 is a plan view of the preferred embodiment of the present invention.
Figure 6:
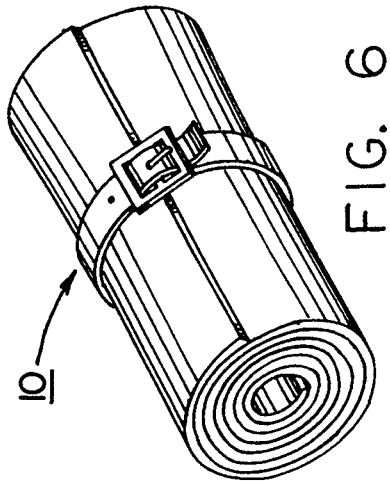
FIG. 6 is a perspective view of the present invention as it is rolled up for transport.
Figure 5:
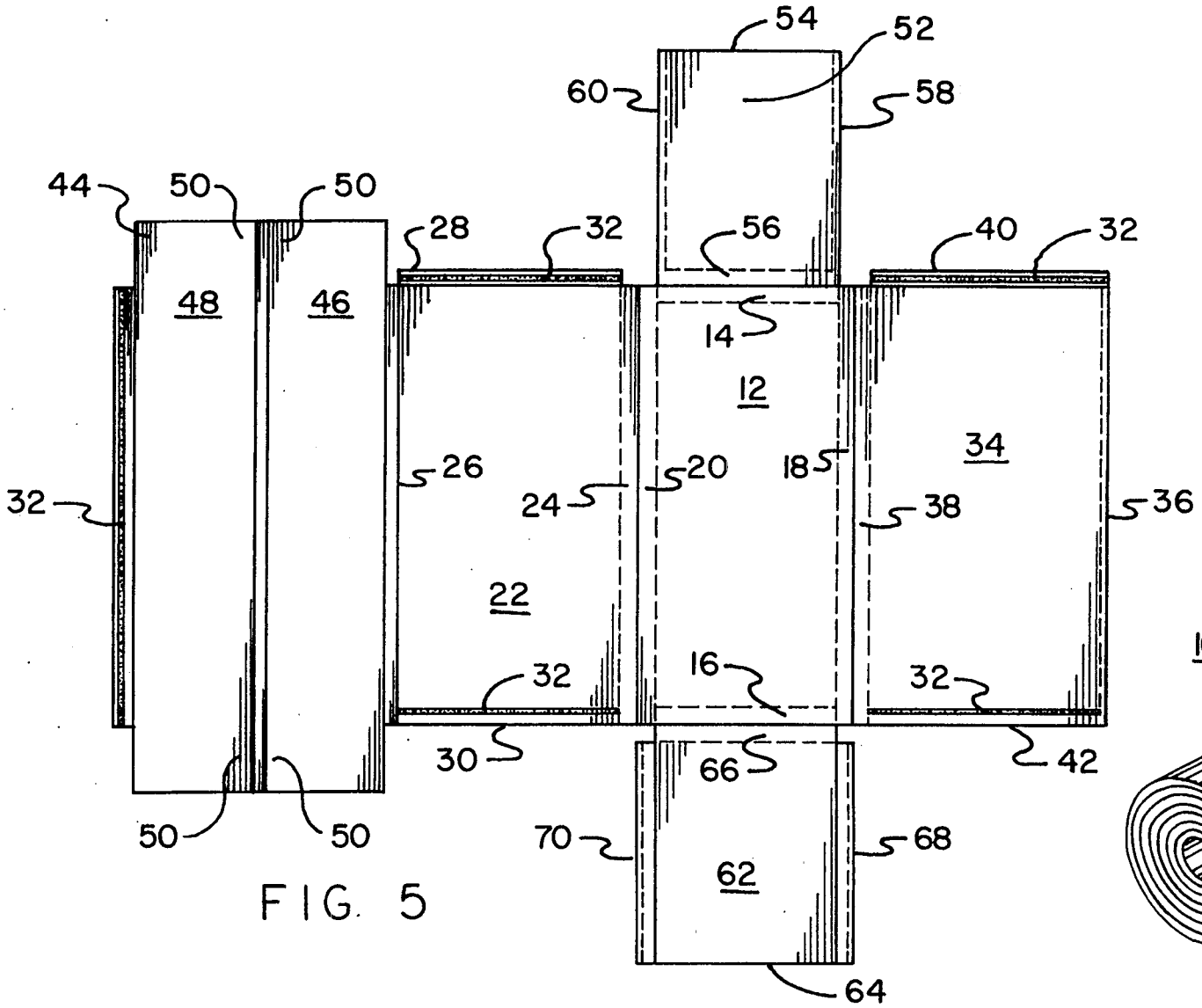
FIG. 5 is a plan view of the present invention illustrated in a deflated state.
Figure 7:
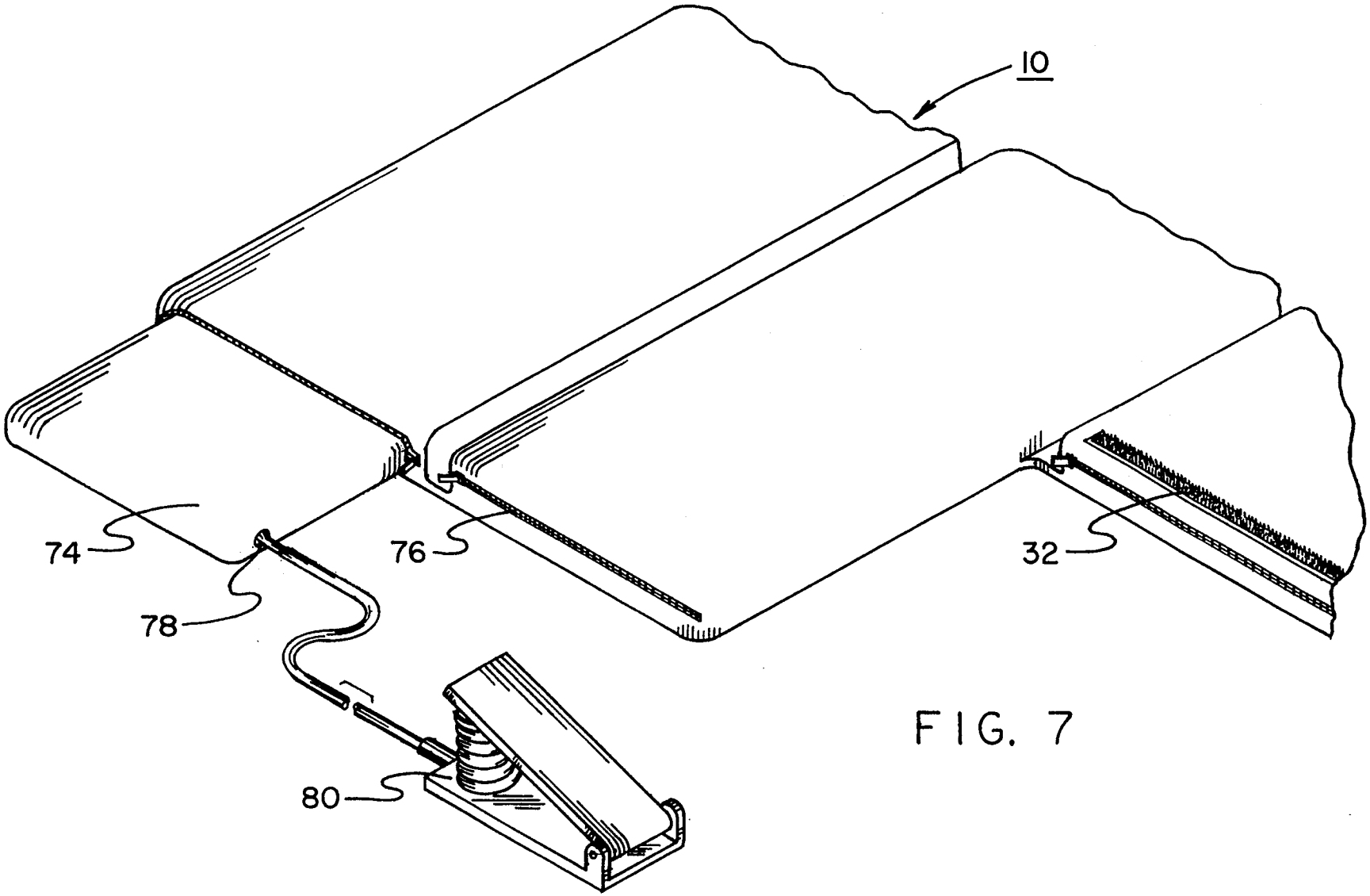
FIG. 7 is a perspective partial view of the inflatable mattress and the pump.

With reference now to the drawings, and in particular, to FIG. 1 thereof, the preferred embodiment of the new and improved inflatable and foldable outdoor bed embodying the principles and concepts of the present invention and generally designated by the reference number 10 will be described.

Specifically, it will be noted in the various Figures that the device relates to a new and improved inflatable and foldable outdoor bed for providing a shelter for the outdoors. In its broadest context, the device consists of a bed portion, a left wall, a right wall, a roof portion, a back portion, a front portion, a triangular end flap, a plurality of inflatable mattresses, and an air pump.

The device 10 contains a bed portion 12 having a top edge 14, a bottom edge 16, a right edge 18, and a left edge 20. The bed portion 12, along with the following portions, is constructed of a waterproof material.

The device 10 contains a left wall 22 having a right edge 24, a left edge 26, a top edge 28, and a bottom edge 30. The right edge 24 is foldably secured to the left edge 20 of the bed portion 12. The top edge 28 and the bottom edge 30 have a VELCRO strip 32 theresecured. The left wall 22 folds upwards perpendicular to the bed portion 12.

The device 10 contains a right wall 34 having a right edge 36, a left edge 38, a top edge 40, and a bottom edge 42. The left edge 38 is foldably secured to the right edge 18 of the bed portion 12. The top edge 40, the bottom edge 42, and the right edge 36 having a VELCRO strip 32 theresecured. The right wall 34 folds upwards perpendicular to the bed portion 12.

The device 10 contains a roof portion 44 having a right portion 46 and a left portion 48. The roof portion 44 has VELCRO 32 on end portions 50 thereof. The left portion 48 has a VELCRO strip 32 secured to an end portion thereof. The right portion 46 is foldably secured to the left edge 26 of the left wall 22. The VELCRO strip 32 of the left portion 48 of the roof portion 44 folds over to the right wall 34 and is secured thereto by the VELCRO strip 32 of the right edge 36 of the right wall 34 with the end portions 50 extending outwardly therefrom.

The device 10 contains a back portion 52 having a top edge 54, a bottom edge 56, a right edge 58, a left edge 60, an inner surface, and an outer surface. The bottom edge 56 is foldably secured to the top edge 14 of the bed portion 12. The outer surface of the right edge 58 and the left edge 60 have VELCRO strips 32 thereon. The back portion 52 folds upwards perpendicular to the bed portion 12 with the VELCRO strips 32 thereof coupling with the VELCRO strips 32 of the top edge 40 of the right wall 34 and the top edge 28 of the left wall 22.

The device 10 contains a front portion 62 having a top edge 64, a bottom edge 66, a right edge 68, a left edge 70, an inner surface, and an outer surface. The top edge 64 is foldably secured to the bottom edge 16 of the bed portion 12. The outer surface of the right edge 68 and the left edge 70 having VELCRO strips 32 thereon. The front portion 62 folds upwards perpendicular to the bed portion 12 with the VELCRO strips 32 thereof coupling with the VELCRO strips 32 of the bottom edge 42 of the right wall 34 and the bottom edge 30 of the left wall 22. The front portion 62 represents the door in which the user enters and exits. Once the front portion 62 is folded upwards, the user will be completely enclosed within the device 10.

The device 10 contains a triangular end flap 72 having VELCRO strips 32 secured to an inner portion thereof. The VELCRO strips 32 of the triangular end flap 72 are coupled with the VELCRO strips 32 on the end portions 50 of the roof portion 44. The triangular end flap 72 prevents water from entering the device 10 when the front portion 62 is not extended.

The device 10 contains a plurality of inflatable mattresses 74. One of the plurality of mattresses 74 are secured within a zippered portion 76 of each of the following: the bed portion, the left wall, the right wall, the roof portion, the back portion, and the front portion. Each of the inflatable mattresses 74 have an inflation tube 78 theresecured. When the plurality of mattresses 74 are deflated, the user is able to fold the elements of the device 10 together and be able to easily carry or store the device 10.

The device 10 contains an air pump 80. The air pump is attachable to the inflation tube 78 of the inflatable mattresses 74. The air pump 80 serves to fill the mattresses 74 with air.

The present invention is a portable bed that provides a shelter and is composed of a waterproof material.

This device is composed of a main body frame, seven inflatable mattresses, a triangular end flap, two rectangular bottom flaps and one foot pump, which all fold together to form a little house. The bed area of this device is approximately thirty-eight inches wide. One of the walls of the device is located on the right side of the bed and the other is located on the left. The front and the back are located above and below the bed and the roof is attached to the left side wall.

To use this device, all of the air mattresses must be filled with air by using the foot pump. Next, each mattress must be placed and secured with zippers in its appropriate location in the main body frame. Once the mattresses are in place, the device must be folded into the shape of an open little house. The two sides and the back bend along the seams and stand in a vertical position. More folding along the seams takes place to put the roof in position and a triangular flap covers each end of the roof. Once the user is inside, he/she may close the front flap to become completely enclosed in the shelter.

This device is lightweight, portable and easy to assemble. It is a convenient shelter from rain and insects, and should be popular with campers.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An inflatable and foldable outdoor bed for providing a shelter for the outdoors comprising, in combination:

a bed portion;

a left wall foldably secured to the bed portion, the left wall folding upwards perpendicular to the bed portion;

a right wall foldably secured to the bed portion, the right wall folding upwards perpendicular to the bed portion;

a roof portion having a right portion and a left portion, the right portion foldably secured to the left wall, the left portion of the roof portion folding over to the right wall and secured thereto with end portions extending outwardly therefrom;

a back portion foldably secured to the bed portion, the back portion folding upwards perpendicular to the bed portion coupling with a top edge of the right wall and a top edge of the left wall;

a front portion foldably secured to the bed portion, the front portion folding upwards perpendicular to the bed portion coupling with a bottom edge of the right wall and a bottom edge of the left wall;

a plurality of inflatable mattresses, one of the plurality of mattresses secured within the bed portion, the left wall, the right wall, the roof portion, the back portion, and the front portion, each of the inflatable mattresses having an inflation tube secured thereto.

2. The bed as described in claim 1 and further including triangular end flap coupled with the end portions of the roof portion.

3. The bed as described in claim 2 and further including an air pump, the air pump attachable to the inflation tube of the inflatable mattresses, the air pump serving to fill the mattresses with air.

4. An inflatable and foldable outdoor bed for providing a shelter for the outdoors comprising, in combination:

a bed portion having a top edge, a bottom edge, a right edge, and a left edge;

a left wall having a right edge, a left edge, a top edge, and a bottom edge, and a zipper portion, the right edge foldably secured to the left edge of the bed portion, the top edge and the bottom edge having a VELCRO strip theresecured, the left wall folding upwards perpendicular to the bed portion;

a right wall having a right edge, a left edge, a top edge, and a bottom edge, the left edge foldably secured to, and a zippered the right edge of the bed portion, the top edge and the bottom edge and the right edge having a VELCRO strip theresecured, the right wall folding upwards perpendicular to the bed portion;

a roof portion having a right portion and a left portion, and a zippered portion the roof portion having VELCRO on end portions thereof, the left portion having a VELCRO strip secured to an end portion thereof, the right portion foldably secured to the left edge of the left wall, the VELCRO strip of the left portion of the roof portion folding over to the right wall and secured thereto by the VELCRO strip of the right edge of the right wall with the end portions extending outwardly therefrom;

a back portion having a top edge, a bottom edge, a right edge, a left edge, an inner surface, and an outer surface and a zippered portion, the bottom edge foldably secured to the top edge of the bed portion, the outer surface of the right edge and the left edge having VELCRO strips thereon, the back portion folding upwards perpendicular to the bed portion with the VELCRO strips thereof coupling with the VELCRO strips of the top edge of the right wall and the top edge of the left wall;

a front portion having a top edge, a bottom edge, a right edge, a left edge, an inner surface, and an outer surface, and a zippered portion the top edge foldably secured to the bottom edge of the bed portion, the outer surface of the right edge and the left edge having VELCRO strips thereon, the front portion folding upwards perpendicular to the bed portion with the VELCRO strips thereof coupling with the VELCRO strips of the bottom edge of the right wall and the bottom edge of the left wall;

a triangular end flap having VELCRO strips secured to an inner portion thereof, the VELCRO strips of the triangular end flap coupled with the VELCRO strips on the end portions of the roof portion;

a plurality of inflatable mattresses, one of the plurality of mattresses secured within a zippered portion of the bed portion, the left wall, the right wall, the roof portion, the back portion, and the front portion, each of the inflatable mattresses having an inflation tube secured thereto;

an air pump, the air pump attachable to the inflation tube of the inflatable mattresses, the air pump serving to fill the mattresses with air.

* * * * *